US007694421B2

(12) United States Patent
Lin

(10) Patent No.: US 7,694,421 B2
(45) Date of Patent: Apr. 13, 2010

(54) FLICK KNIFE WITH A LEVER FRAME

(76) Inventor: Paul Lin, 4F, No. 102, Sec. 1, Roosevelt Rd., Taipei (TW)

( * ) Notice: Subject to any disclaimer, the term of this patent is extended or adjusted under 35 U.S.C. 154(b) by 516 days.

(21) Appl. No.: 11/763,925

(22) Filed: Jun. 15, 2007

(65) Prior Publication Data

US 2008/0307656 A1 Dec. 18, 2008

(51) Int. Cl.
*B26B 1/04* (2006.01)

(52) U.S. Cl. ..... 30/159; 30/160

(58) Field of Classification Search ..... 30/155, 30/158–160, 161

See application file for complete search history.

(56) References Cited

U.S. PATENT DOCUMENTS

| | | | | |
|---|---|---|---|---|
| 2,461,941 | A * | 2/1949 | Sutton | 294/26 |
| 4,451,982 | A * | 6/1984 | Collins | 30/161 |
| 5,815,927 | A * | 10/1998 | Collins | 30/161 |
| 5,875,552 | A * | 3/1999 | Chen | 30/161 |
| 6,079,106 | A * | 6/2000 | Vallotton | 30/161 |
| 6,101,723 | A * | 8/2000 | Ford | 30/157 |
| 6,145,202 | A * | 11/2000 | Onion | 30/160 |
| 6,158,127 | A * | 12/2000 | Taylor | 30/158 |
| 6,378,214 | B1 * | 4/2002 | Onion | 30/161 |
| 6,397,476 | B1 * | 6/2002 | Onion | 30/160 |
| 6,397,477 | B1 * | 6/2002 | Collins | 30/161 |
| 6,918,184 | B2 * | 7/2005 | Glesser | 30/161 |
| 7,080,457 | B2 * | 7/2006 | Sullivan | 30/160 |
| 7,107,685 | B1 * | 9/2006 | Anderson | 30/158 |
| 7,121,005 | B2 * | 10/2006 | Hughes | 30/158 |
| 7,124,510 | B2 * | 10/2006 | Frazer | 30/161 |
| 7,406,896 | B2 * | 8/2008 | Rivera | 81/177.4 |
| 7,506,446 | B2 * | 3/2009 | Onion | 30/160 |
| 2001/0023541 | A1 * | 9/2001 | Blanchard | 30/161 |
| 2002/0104220 | A1 * | 8/2002 | Marfione | 30/160 |
| 2003/0145468 | A1 * | 8/2003 | Glesser | 30/161 |
| 2004/0045170 | A1 * | 3/2004 | Glesser | 30/161 |
| 2004/0068874 | A1 * | 4/2004 | Chu | 30/161 |
| 2004/0078981 | A1 * | 4/2004 | Cheng | 30/161 |
| 2004/0088865 | A1 * | 5/2004 | Onion | 30/161 |
| 2004/0139613 | A1 * | 7/2004 | Onion et al. | 30/161 |
| 2005/0172497 | A1 * | 8/2005 | Linn et al. | 30/161 |
| 2005/0262701 | A1 * | 12/2005 | Lai | 30/161 |
| 2006/0168817 | A1 * | 8/2006 | Kao | 30/153 |
| 2006/0200995 | A1 * | 9/2006 | Anderson | 30/153 |
| 2007/0068001 | A1 * | 3/2007 | Steigerwalt | 30/161 |
| 2007/0130778 | A1 * | 6/2007 | Ruggiero | 30/161 |
| 2007/0204468 | A1 * | 9/2007 | Cheng | 30/160 |
| 2008/0307656 | A1 * | 12/2008 | Lin | 30/159 |
| 2009/0013537 | A1 * | 1/2009 | Kao | 30/159 |
| 2009/0288301 | A1 * | 11/2009 | Hawk et al. | 30/161 |

* cited by examiner

*Primary Examiner*—Kenneth E. Peterson
*Assistant Examiner*—Sean Michalski
(74) *Attorney, Agent, or Firm*—patenttm.us

(57) ABSTRACT

A flick knife with a lever frame has a hilt, a blade, a lever frame and a spring. The blade has a proximal end pivotally mounted in the hilt. The lever frame is mounted through the hilt and has a front connector that abuts the proximal end of the blade to rotate the blade, and a rear connector. The spring is mounted inside the hilt and connects the hilt to the rear connector of the lever frame and eases opening of the blade and prevents the blade from opening. Because the spring is mounted in the hilt, the knife is thinner than prior art and therefore more convenient.

7 Claims, 6 Drawing Sheets

FLICK KNIFE WITH A LEVER FRAME

BACKGROUND OF THE INVENTION

1. Field of the Invention

The present invention relates to a flick knife, especially to a flick knife that has a lever frame mounted on the hilt that abuts a proximal end of the blade to help people unfold the blade and reduces a size of the knife.

2. Description of the Prior Arts

A foldable knife where the blade is folded into the hilt is popular since it can be safely stored and conveniently taken out for outdoor activities. A flick knife is one type of foldable knives and has a spring mounted between the hilt and the blade and pushing the blade out of the covers to unfold the blade.

A conventional flick knife has two covers, a blade and a torsion spring. The two covers are separately connected to each other to form a hilt. The blade is mounted between the two covers, and has a proximal end pivotally connected to the hilt and a locking structure to selectively hold the blade unfolded. The torsion spring is mounted in one of the covers, and connects to the blade and the cover.

Therefore, the cover must be thick enough to hold a torsion spring and this is inconvenient to carry. Since the torsion spring is mounted on one side of the blade, the torsion spring imposes a greater force to one side over the other which may prevent smooth rotation.

To overcome the shortcomings, the present invention provides a flick knife with a lever frame to mitigate or obviate the aforementioned problems.

SUMMARY OF THE INVENTION

The main objective of the present invention is to provide a flick knife with a lever frame comprising a hilt, a blade, a lever frame and a spring. The blade has a proximal end pivotally mounted in the hilt. The lever frame is mounted through the hilt and has a front connector that abuts the proximal end of the blade to rotate the blade, and a rear connector. The spring is mounted in the hilt and connects the hilt and the rear connector of the lever frame. Therefore, reducing a thickness of the flick knife which is more convenient for people to carry. The front connector can impose equivalent force on the blade to rotate the blade smoothly.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
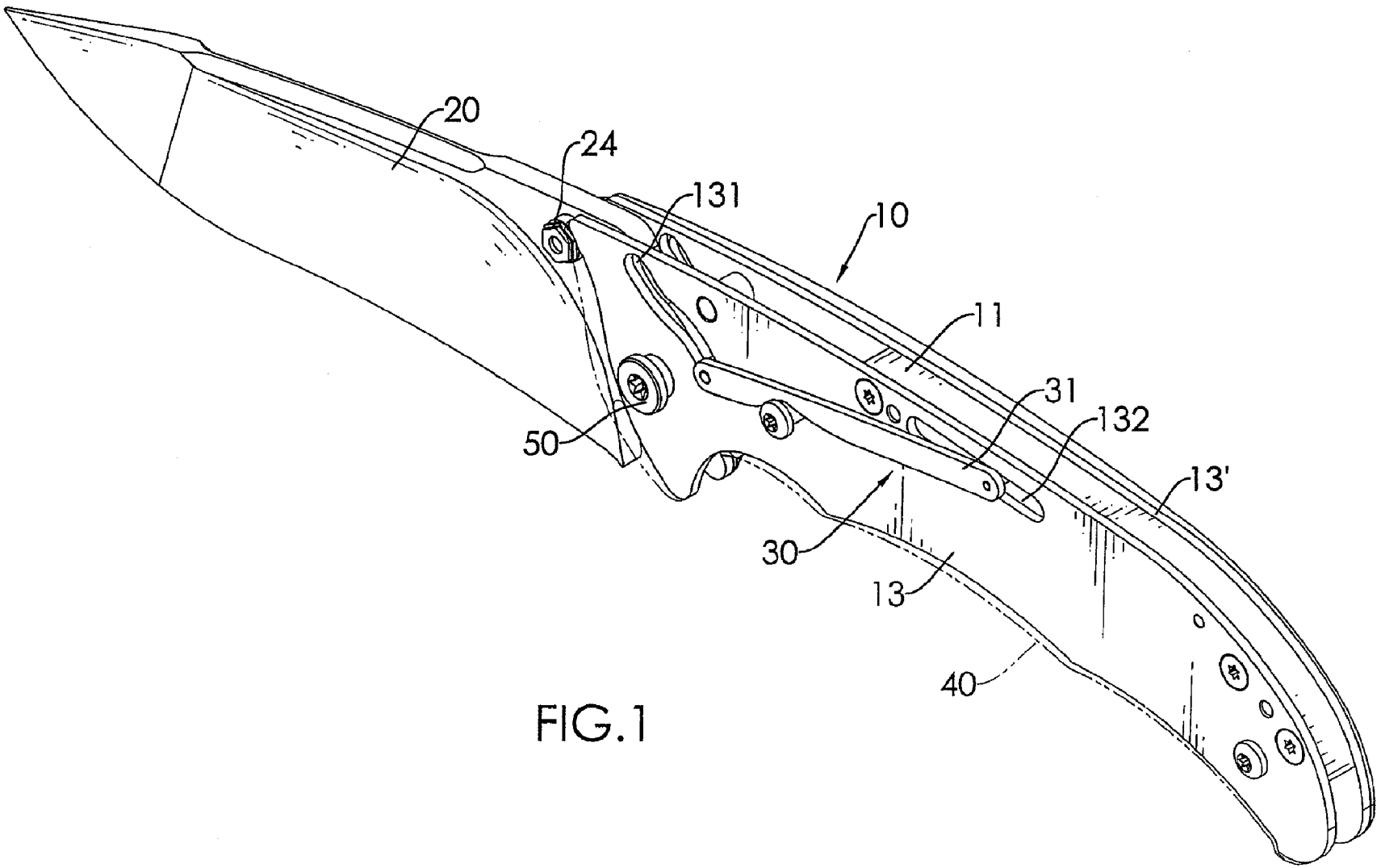
FIG. 1 is a perspective view of a flick knife with a lever frame in accordance with the present invention.
Figure 2:
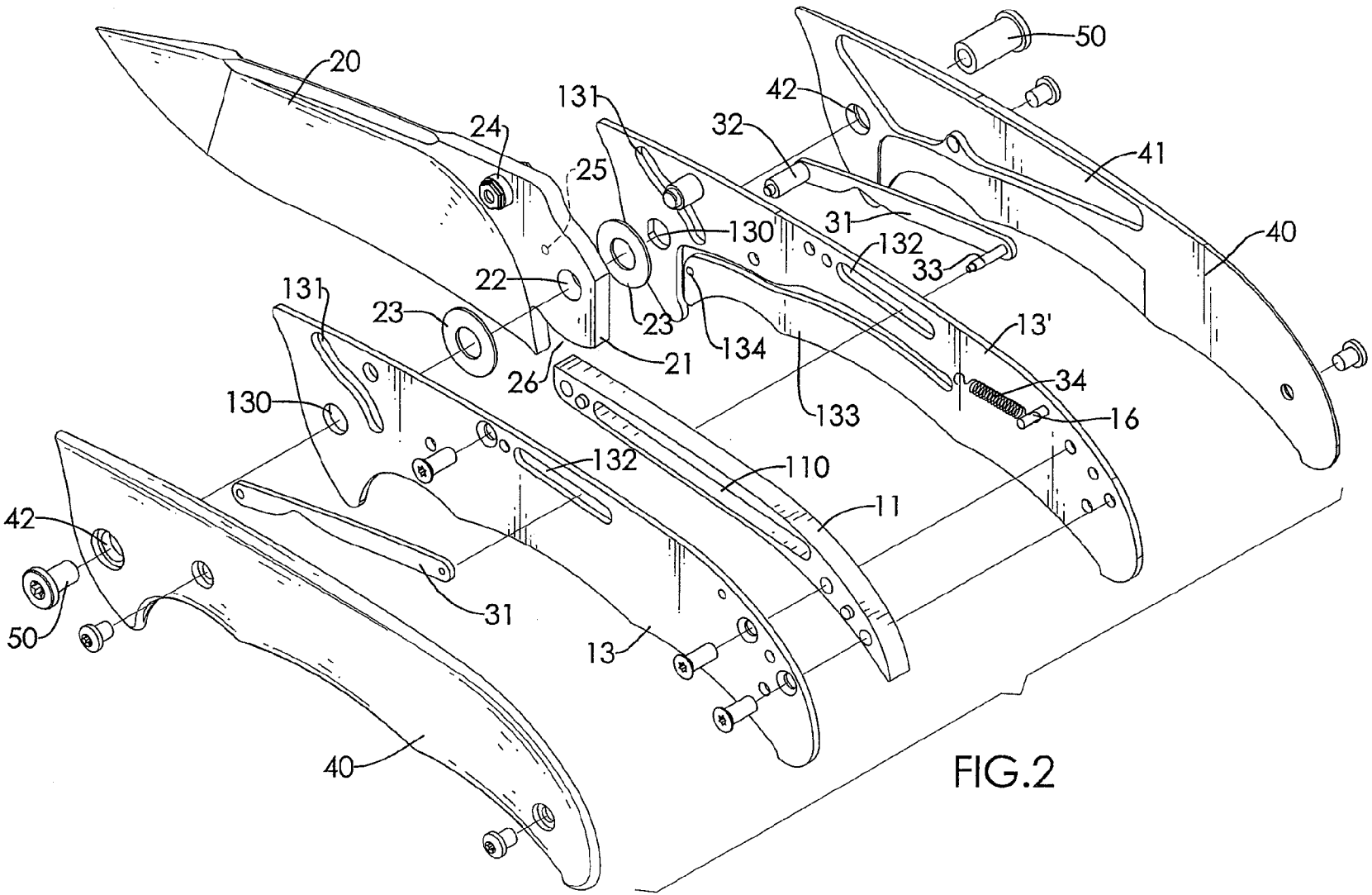
FIG. 2 is an exploded perspective view of the flick knife in FIG. 1.

With reference to FIGS. 1 and 2, a flick knife with a lever frame in accordance with the present invention comprises a hilt (10), a blade (20), a lever frame (30), a pintle (50) and may have two grips (40).

The hilt (10) has a base (11), two covers (13, 13'), an open pawl, a close pawl and a spring mount (16).

The base (11) has two side surfaces and an elongated slot (110). The elongated slot (110) is formed through the base (11) and has a rear end.

The covers (13, 13') are mounted respectively on the side surfaces of the base (11) and each cover (13, 13') has an inner surface, a pivot hole (130), a front track (131) and an elongated slot (132).

The pivot hole (130) is formed through the cover (13, 13'). The front track (131) is formed through the cover (13, 13') near the pivot hole (130). The elongated slot (132) is formed through the cover (13, 13') and aligns with the elongated slot (110) of the base (11).

The open pawl is mounted in the hilt (10) and may be a latch (133). The latch (133) is formed on and extends out from the cover (13'), is bent towards the base (11), and has an inner surface and an abutting edge.

The close pawl is mounted in the hilt (10) and may be a limit (134). The limit (134) is formed on the inner surface of the latch (133) and may be a ball mounted securely in the latch (133).

The spring mount (16) is mounted in one of the covers (13) and extends in the rear end of the elongated slot (110) of the base (11).

The blade (20) is pivotally mounted between the covers (13, 13'), is selectively folded into the hilt (10), is held alternatively by the open and close pawls in the hilt (10), has a proximal end, a pivot hole (22), a straight edge (21), an arced edge (26), and may have two washers (23), a positive stop (24) and a closed detent (25).

The pivot hole (22) is formed through the proximal end of the blade (20) and aligns with the pivot holes (130) in the covers (13, 13').

The straight edge (21) and the arced edge (26) are formed at the proximal end of the blade (20). The straight edge (21) selectively abuts the open pawl in the hilt (10) and may selectively abut the abutting edge of the latch (133) on the cover (13').

The washers (23) are mounted respectively between the blade (20) and each cover (13, 13'). The positive stop (24) is mounted in and extends out from the blade (20) and selectively abuts the covers (13, 13') when the blade (20) is unfolded.

Figure 5:
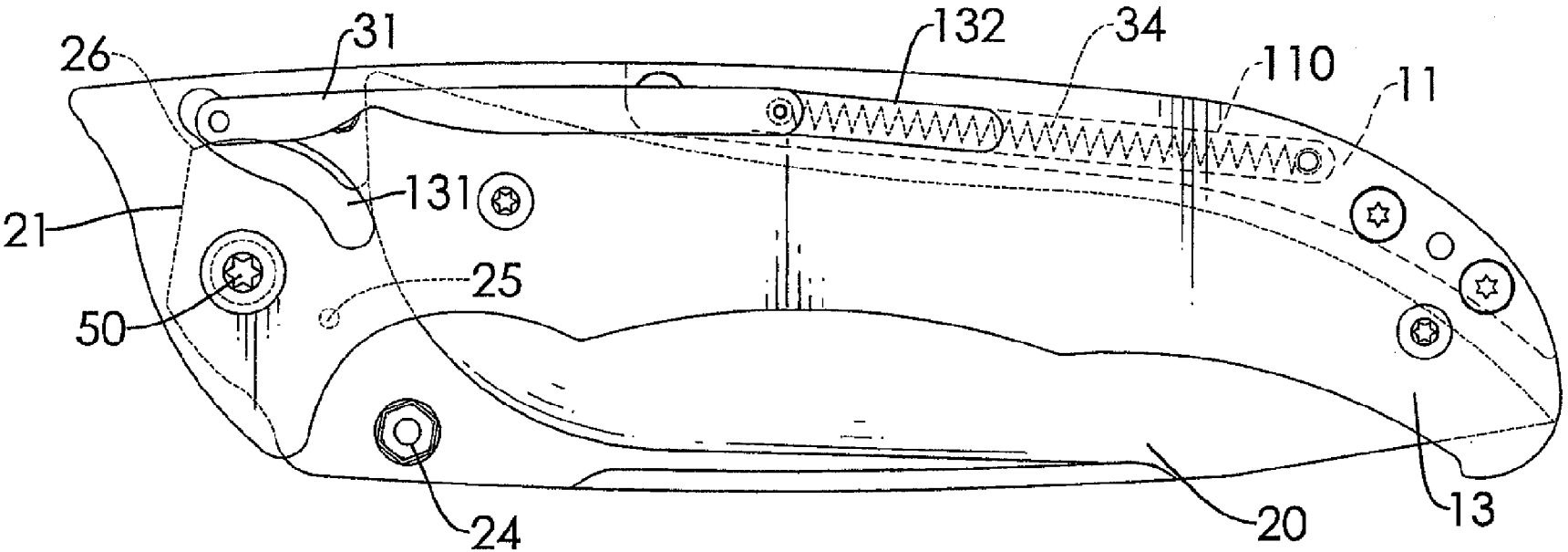
FIG. 5 is an operational side view of the flick knife in FIG. 1 with the blade folded.

With further reference to FIG. 5, the closed detent (25) is formed in the blade (20) corresponding to and selectively mounted around the limit (134) when the blade (20) is folded to prevent that the blade (20) from accidental opening.

The lever frame (30) is slidably mounted on the hilt (10) and has two bars (31), a front connector (32), a rear connector (33) and a spring (34). Each bar (31) has a front end and a rear end. The front connector (32) extends through the front tracks (131) of the covers (13, 13'), connects to the front ends of the bars (31) and abuts the proximal end of the blade (20). The rear connector (33) is mounted through the elongated slots (110, 132) of the base (11) and the two covers (13, 13') and connects to the rear ends of the bars (31). The spring (34) connects the rear connector (33) to the spring mount (16) of the hilt (10).

The grips (40) are respectively mounted on the outer surfaces of the covers (13, 13') and each has an inner surface, a recess (41) and a pivot hole (42). The recess (41) is formed on the inner surface of each grip (40) and allows the lever frame (30) to slide. The pivot hole (42) is formed through the grip (40) and aligns with the pivot holes (130, 22) of the covers (13, 13') and the blade (20).

The pintle (50) is mounted through the pivot holes (42, 130, 22) of the grips (40), the two covers (13, 13') and the blade (20), and the washers (23) to mount the blade (20) pivotally in the hilt (10).

Figure 3:
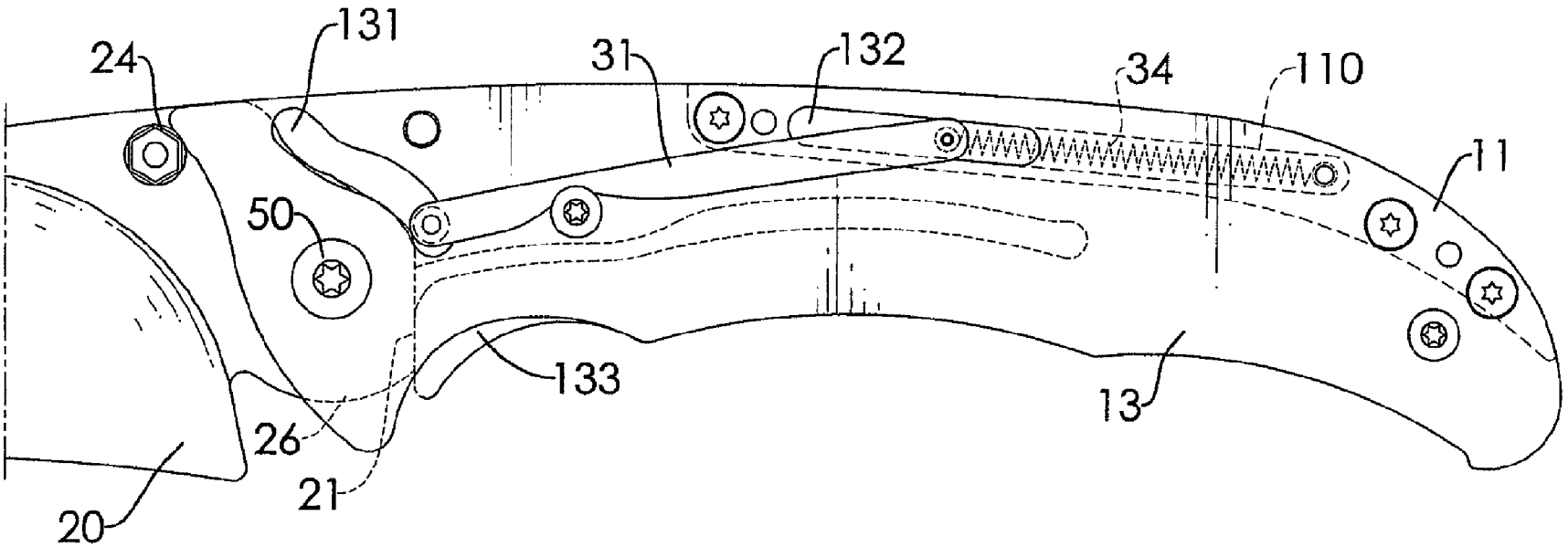
FIG. 3 is a side view of the flick knife in FIG. 1.
Figure 4:
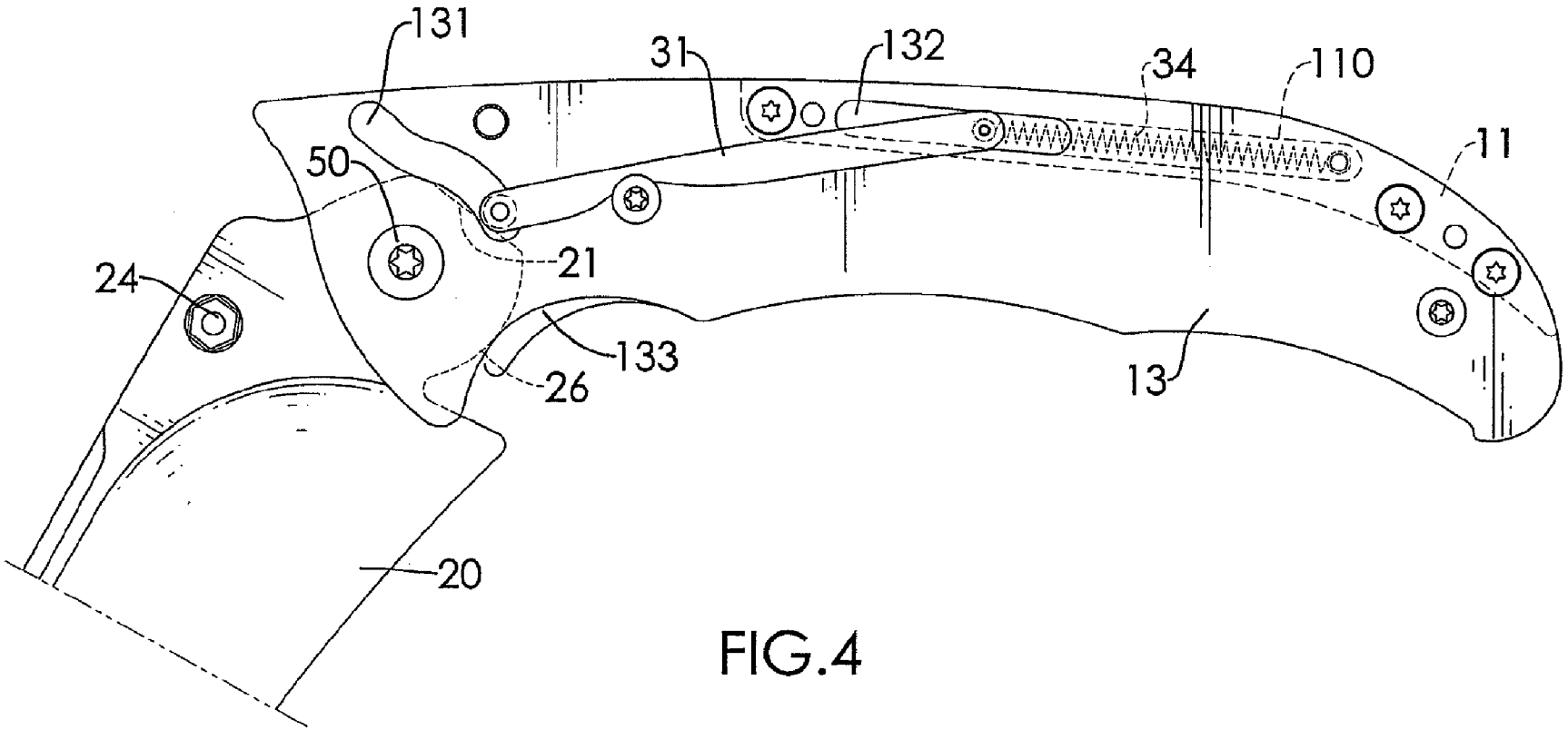
FIG. 4 is an operational side view of the flick knife in FIG. 1, showing the blade being unfolded.
Figure 6:
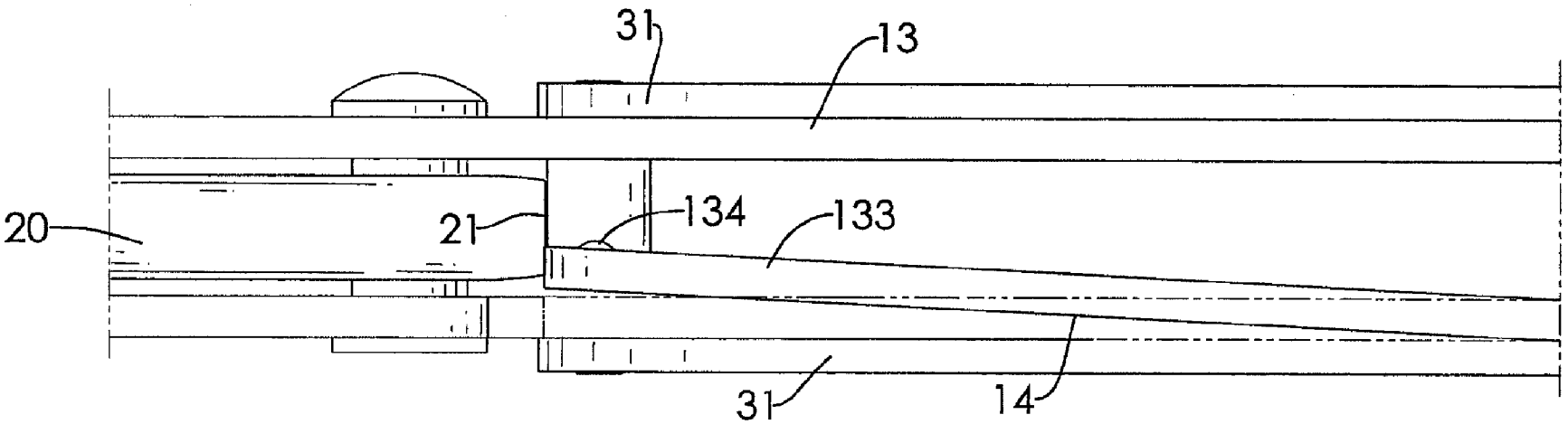
FIG. 6 is a bottom view of the flick knife in FIG. 1.

With further reference to FIGS. 3, 4 and 6, when the blade (20) is pulled out of the hilt (10) slightly, the front connector (32) passes over the corner of the proximal end of the blade (20). The spring (34) pulls the lever frame (30) along the arced edge (26) of the blade (20) to push the blade (20) out quickly until the straight edge (21) of the blade (20) abuts the covers (13, 13'). The blade (20) abuts the abutting edge of the latch (133) to lock the blade (20) in place.

When the blade (20) is closed, the latch (133) is deactivated. Then, the blade (20) is pivoted into the hilt (10) until the front connector (32) abuts the arced edge (26) of the blade (20) to hold the blade (20) closed. The limit (134) of the latch (133) may further be mounted in the detent (25) of the blade (20) to prevent accidental opening.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A flick knife with a lever frame comprising
a hilt having
a base having
two side surfaces; and
an elongated slot being formed through the base and having a rear end;
two covers being mounted respectively on the side surfaces of the base and each cover having
an inner surface;
a pivot hole being formed through the cover;
a front track being formed through the cover near the pivoting hole; and
an elongated slot being formed through the cover and aligning with the elongated slot of the base;
an open pawl being mounted in the hilt;
a close pawl being mounted in the hilt; and
a spring mount being mounted in one of the cover and extending in the rear end of the elongated slot of the base;
a blade being pivotally mounted between the covers, being selectively folded into the hilt, being held alternatively by the open and close pawls in the hilt and having
a proximal end;
a pivot hole being formed through the proximal end of the blade and aligning with the pivot holes in the covers;
a straight edge being formed at the proximal end of the blade and selectively abutting the open pawl in the hilt; and
an arced edge being formed at the proximal end of the blade;
a lever frame being slidably mounted on the hilt and having two bars, each having
a front end; and
a rear end;
a front connector extending through the front tracks of the covers, connecting to the front ends of the bars and abutting the proximal end of the blade;
a rear connector being mounted through the elongated slots of the two covers and the base and connecting to the rear ends the bars; and
a spring connecting the rear connector to the spring mount of the hilt; and
a pintle being mounted through the pivot holes of the covers and the blade.

2. The flick knife as claimed in claim 1, wherein the open pawl is a latch being formed on and extending out from the cover, being bent towards the base and having
an inner surface; and
an abutting edge.

3. The flick knife as claimed in claim 2, wherein
the close pawl is a limit being formed on the inner surface of the latch; and
the blade further has a closed detent being formed in the blade corresponding to and selectively mounted around the limit.

4. The flick knife as claimed in claim 3, wherein the limit of the hilt is a ball mounted securely in the latch.

5. The flick knife as claimed in claim 4, wherein the blade further has two washers being mounted respectively between the blade and the covers.

6. The flick knife as claimed in claim 5, wherein the blade further has a positive stop being mounted in and extending out from the blade and selectively abutting the covers.

7. The flick knife as claimed in claim 6, wherein the flick knife further comprises two grips being respectively mounted on the outer surfaces of the covers and each having
an inner surface;
a recess being formed on the inner surface of the grip to allow the lever frame to slide; and
a pivot hole being formed through the grip and aligning with the pivot holes of the covers and the blades; and
the pintle being further mounted through the pivoting hole of the grips.

* * * * *